United States Patent [19]

Putnam

[11] Patent Number: 4,531,655

[45] Date of Patent: Jul. 30, 1985

[54] CONTAINER FOR FLUIDS

[76] Inventor: Joe A. Putnam, 14007 Two Notch Ct., Midlothian, Va. 23113

[21] Appl. No.: 504,613

[22] Filed: Jun. 15, 1983

[51] Int. Cl.[3] ..... B65D 47/22

[52] U.S. Cl. ..... 222/105; 222/131; 222/183; 222/471; 222/528; 222/529; 222/559; 220/262; 220/404

[58] Field of Search ..... 222/105–106, 222/96, 131, 183, 386.5, 465 A, 470–473, 559, 527–529, 505; 220/262, 404; 215/13 A, 12 R

[56] References Cited

U.S. PATENT DOCUMENTS

| | | | |
|---|---|---|---|
| 2,312,584 | 3/1943 | Peterson | 222/470 |
| 3,255,932 | 6/1966 | Hunter et al. | 222/183 |
| 4,098,434 | 7/1978 | Uhlig | 222/105 X |
| 4,286,733 | 9/1981 | Weikert | 222/528 X |

FOREIGN PATENT DOCUMENTS

| | | | |
|---|---|---|---|
| 28107 | 5/1956 | Finland | 222/183 |

*Primary Examiner*—Charles A. Marmor
*Attorney, Agent, or Firm*—Glen M. Burdick

[57] ABSTRACT

An improved container for the storage and dispensing of fluids comprising a substantially rigid support container having a pouring and receiving mouth, a collapsible, fluid impermeable container disposed within and supported by the support container, the collapsible container communicating with the mouth of the support container, and primary sealing assembly supported by the support container and movable between a first position for selectively opening the collapsible container and a second position for closing or sealing the collapsible container. A handle assembly for the support container is also provided, the handle assembly having an elongated upper segment substantially normally disposed to a central elongated axis of the support container and adapted to receive the primary sealing assembly of the container.

27 Claims, 8 Drawing Figures

CONTAINER FOR FLUIDS

BACKGROUND OF THE INVENTION

1. Field of the Invention

The present invention relates to containers for fluids, and more particularly but not by way of limitation, to an improved container for the storage and dispensing of liquids having a collapsible container disposed within and supported by a support container, the collapsible container being selectively opened and closed to permit flow of liquids and gases into and from the collapsible container.

2. Brief Description of the Prior Art

Liquids, such as carbonated beverages, are generally sold to the consuming public in bottles or cans. Previously, the carbonated beverages were marketed in containers representative of individually servings. However, in recent years the volume capacity of the containers has been substantially increased. Due to a number of factors, including the cost of packaging such carbonated beverages, the size of the containers for the carbonated beverages has increased and it has become customary to store unused portions of the beverage in the container in a refrigerator. However, carbonated beverages tend to lose their carbonation, even when the cap is replaced on the container, thus rendering the beverages "flat" after a relatively short period of time. This has required the user to either consume the entire contents of the container in a relatively short period of time, or in many instances to discard the remaining contents of the container.

Another common problem encountered is the storage of milk and/or fruit drinks in the refrigerator for an effective period of time to allow consumption of the beverages without the beverages picking up undesirable tastes from other items stored in the refrigerator, or becoming stale or soured. When this occurs the user must discard the remaining contents in the container. Thus, a need has long existed for improved containers for the storage of liquids, especially carbonated beverages. Further, it would be highly desirable for such a container to be capable of being selectively closed or sealed to substantially prevent the contents in the container from either losing dissolved gases, such as the carbonation in a soft drink beverage, or to prolong the life of the contents stored within the container by substantially preventing the contents of the container from developing undesirable tastes or odors as a result of other constituents stored within the refrigerator.

SUMMARY OF THE PRESENT INVENTION

The present invention provides an improved liquid container for the storage and dispensing of liquids, such as carbonated beverages, which substantially prolongs the life of the beverage stored therein by retarding the escape of the carbonation of such beverage during the storage of the beverage. In one aspect, the present invention provided an improved liquid container which substantially prevents the beverage stored therein from acquiring the taste and/or odor of other items stored in the vicinity of the container.

Broady, the improved liquid container of the present invention comprises a substantially rigid support container having a body portion defining a pouring and receiving mouth; a collapsible, fluid impermeable container disposed within and supported by the support container, the collapsible container openly communicating with the mouth of the support container; and a primary sealing assembly supported by the support container and adapted to be selectively moved between a first position for opening the collapsible container and a second position for closing the collapsible container.

An object of the present invention is to provide an improved storage container for liquids which substantially prolongs the life of the liquid stored therein.

Another object of the present invention, while achieving the above stated object, is to provide an improved liquid storage and dispensing container which can be selectively opened and closed for the introduction or dispensing of fluids into and from the container.

Another object of the present invention, while achieving the above stated objects, is to provide an improved liquid storage and dispensing container wherein the air space in the container above the liquid stored therein is maintained at a minimum volume.

Other objects, features and advantages of the present invention will become clear upon reading the following detailed description in conjunction with the drawings and the appended claims.

BRIEF DESCRIPTION OF THE DRAWINGS

FIG. 6A is a top plan view of a first stopper assembly of a secondary sealing assembly for closing the pouring and receiving mouth of the support container.

FIG. 6B is a side elevational view of a second stopper member of the secondary sealing assembly positionable within the first stopper member of FIG. 6A for selectively opening and closing the pouring and receiving mouth of the support container.

DESCRIPTION

Figure 1:
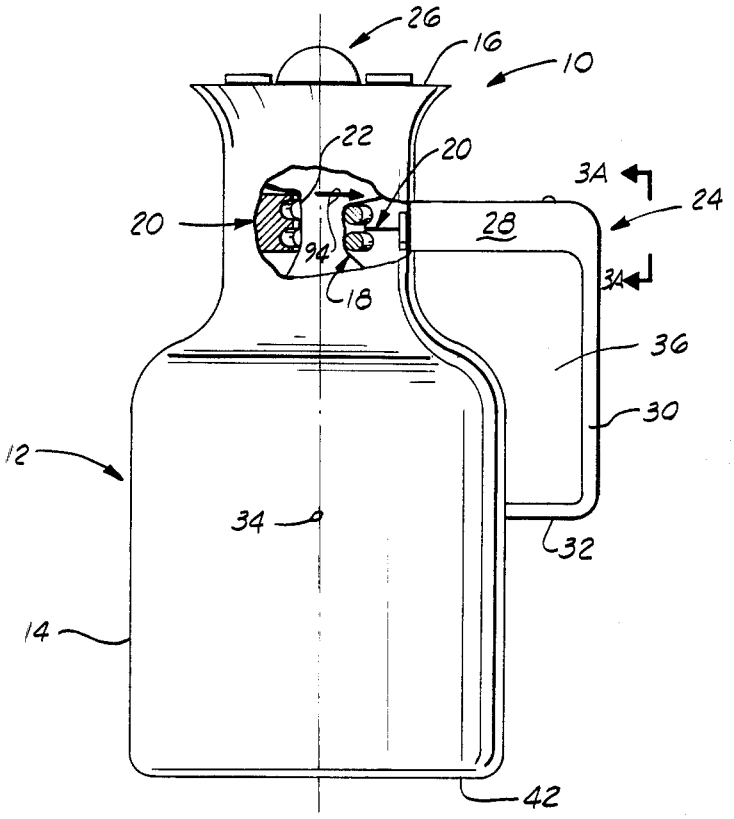
FIG. 1 is a partial cutaway elevational view of a container for the storage and dispensing of liquids constructed in accordance with the present invention and illustrating a primary sealing assembly in a first position.
Figure 2:
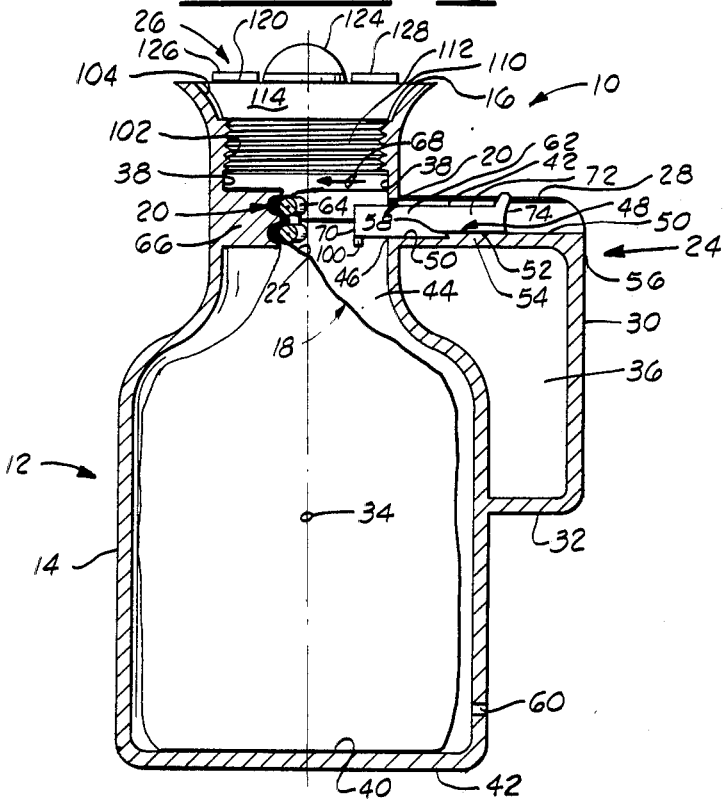
FIG. 2 is a partial cutaway elevational view of the container of the present invention and illustrating the primary sealing assembly in a second position.

Referring to the drawings, and more particularly to FIGS. 1 and 2, shown therein is a liquid storage and dispensing container 10 constructed in accordance with the present invention. The liquid storage and dispensing container 10 comprises a substantially rigid support container 12 having a body portion 14 defining a pouring and receiving mouth 16, a collapsible container 18 disposed within and supported by the body portion 14 of the support container 12, and a primary sealing assembly 20 supported by the support container 12. The primary sealing assembly 20 is movable between a first position (as illustrated in FIG. 1) and a second position (as illustrated in FIG. 2). In the first position the primary sealing assembly 20 is withdrawn from seating engagement with an upper portion 22 of the collapsible container 18 so that fluid communication is established between the collapsible container 18 and the pouring and receiving mouth 16 of the support container 12; whereas when the primary sealing assembly 20 is in the second position the primary sealing assembly 20 engages the upper portion 22 of the collapsible container 18 to substantially seal or close the collapsible container 18 from fluid communication with the pouring and receiving mouth 16 of the support container 12.

The liquid storage and dispensing container 10 further comprises a handle assembly 24 supported by the support container 12, and a secondary sealing assembly 26 positionable within the pouring and receiving mouth 16 of the support container 12 for selectively closing the pouring and receiving mouth 16.

The handle assembly 24 is characterized as having an upper segment 28, a medial or body segment 30, and a lower segment 32. The upper segment 28 of the handle assembly 24, an elongated member, is connected to and supported by the body portion 14 of support container 12 such that the elongated upper segment 28 is substantially normally disposed to a central elongated axis 34 of the support container 12. The lower segment 32 of the handle assembly 24 is connected to and supported by the body portion 14 of the support container 16 so as to be in a spatial relationship with the elongated upper segment 28 of the handle assembly 24. The medial or body segment 30 of the handle assembly 24 is disposed between and connected to the elongated upper segment 28 and the spatially disposed lower segment 32 so that an opening 36 is formed therebetween, the opening 36 allowing a person to grasp and hold the liquid storage and dispensing container 10 via the handle assembly 24.

The collapsible container 18 is provided with an upper end 38 and a lower or bottom end 40. The upper end 38 of the collapsible container 18 is connected to the support container 12 at a position in close proximity to the pouring and receiving mouth 16 so as to provide a fluid tight seal between the support container 12 and the upper end 38 of the collapsible container 18. In order to stabilize the collapsible container 18 within the support container 12, especially when tilting the liquid storage and dispensing container 10 to dispense liquids therefrom, a substantially centrally disposed portion of the lower end 40 of the collapsible container 18 is connected to a bottom or support portion 42 of the support container 12. Any suitable means known in the art can be employed to connect the upper portion 38 and the centrally disposed portion of the lower or bottom end 40 of the collapsible container 18 to the support container 12, such as heat sealing and the like.

Figure 3A:
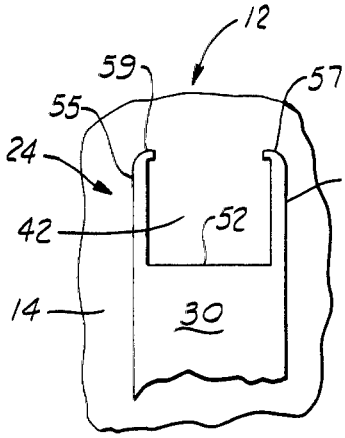
FIG. 3A is a partial end view of a handle assembly of the container taken along the line 3A—3A of FIG. 1 having a ram assembly of the primary sealing assembly for sealing of the container removed therefrom.
Figure 3B:
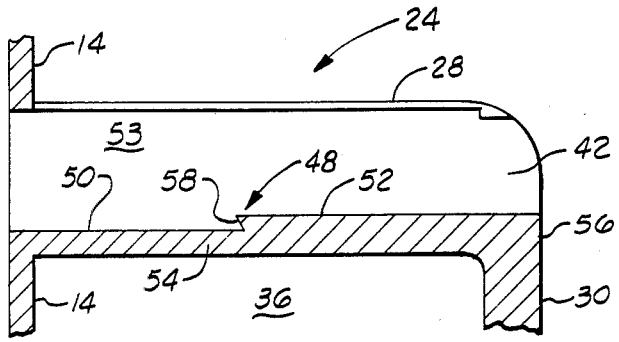
FIG. 3B is a partial cutaway elevational view of the handle assembly of the container having the ram assembly removed therefrom.

Referring now to FIGS. 2, 3A and 3B, the elongated upper segment 28 of the handle assembly 24 is provided with an elongated slot 42 formed therein. The elongated slot 42 communicates with an interior portion 44 of the support container 12 via an opening 46 formed in the body portion 14 of the support container 12. A stop member 48 is formed on a support surface 50 defining the elongated slot 42 in the upper segment 28 of the handle assembly 24. The stop member 48 is adapted to selectively engage and lock the primary sealing assembly 20 in the second position for sealing and closing the collapsible container 18. The stop member 48 is illustrated as a ridge element 52 which protrudes upwardly from the support surface 50 of the upper segment 28 and into the elongated slot 42 of the handle assembly 24. The ridge element 52 extends from a medial portion 54 of the upper segment 28 of the handle assembly 24 to an outwardly extending distal end 56 of the upper segment 28.

The primary sealing assembly 20 is slidably positioned within the elongated slot 42 formed in the upper segment 28 of the handle assembly 24 for selective movement therethrough between the first position wherein the collapsible container is in open fluid communication with the pouring and receiving mouth 16 of the support container 12 and the second position wherein the collapsible container is sealed and closed. One end 58 of the ridge element 52 is beveled substantially as shown and is adapted to engage a portion of the primary sealing assembly 20 to secure the primary sealing assembly 20 in the second position substantially as shown in FIG. 2. The upwardly extending side portions 53 and 55 of the upper segment 28 of the handle assembly 24 are provided with retaining lip members 57 and 59, respectively, which assist in the stabilization of the primary sealing assembly 20 in the elongated slot 42.

In order to minimize the volume of air space above the liquid in the collapsible container 18 as liquid is removed therefrom, a pressure equalizing aperture 60 is provided in the body portion 14 of the support container 12 substantially as shown in FIG. 2. The pressure equalizing aperture 60 establishes fluid communication between the interior portion 44 of the support container 12 and the ambient environment of the support container 12 so that as fluids are dispensed from the collapsible container 18 the equalization of the pressure between the interior portion 44 of the support container 12 and the ambient environment insures that the collapsible container 18 collapses in an amount substantially equal to the volume of fluid removed and thus maintains the volume of air space above the liquid in the collapsible container 18 at a minimum.

Figure 4:
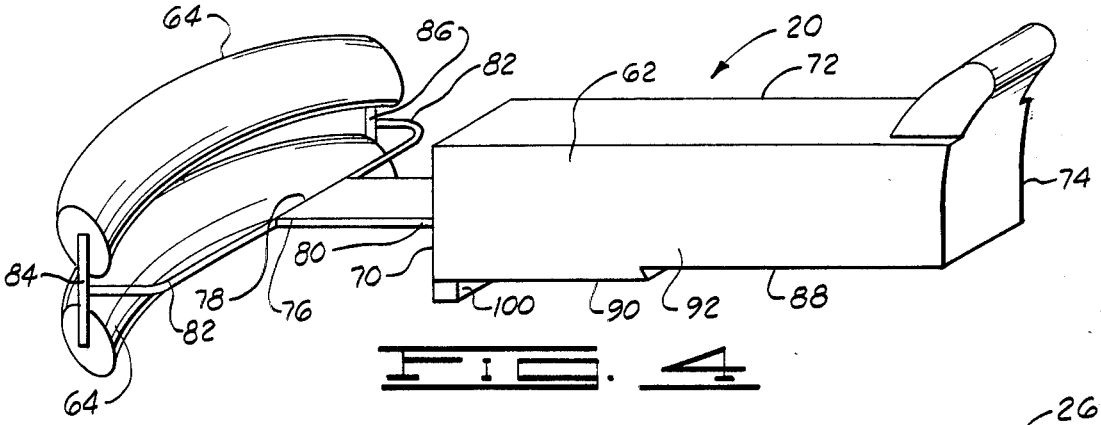
FIG. 4 is an isometric view of the ram assembly of the primary sealing assembly for selectively opening and closing a collapsible container of the container of the present invention.
Figure 5:
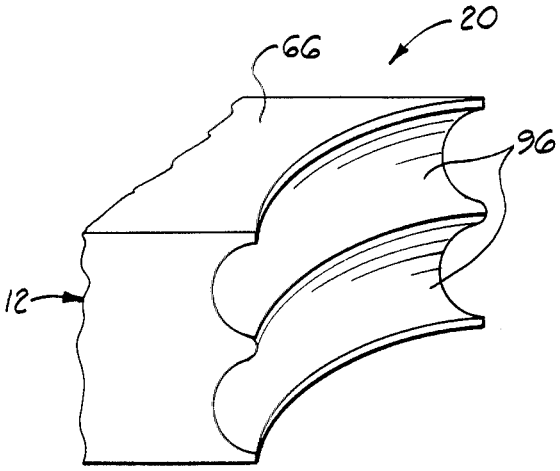
FIG. 5 is an enlarged fragmentary prospective view of a seating member supported within an interior portion of the support container, the seating member adapted to receive a male member of the ram assembly for selectively closing the collapsible container when the ram assembly is in the second position.
Figure 5A:
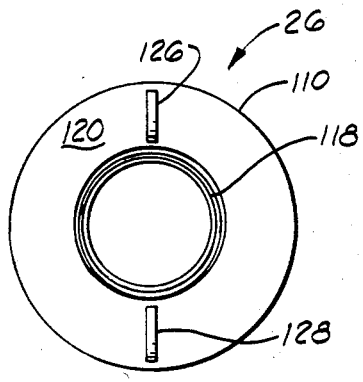
Figure 5B:
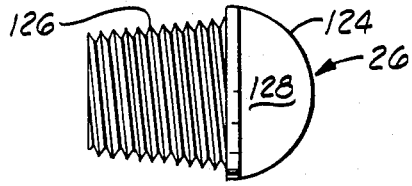

Referring now to FIGS. 2, 4 and 5, the primary sealing assembly 20 of the liquid storage and dispensing container 12 comprises a ram 62 slidably positioned within the elongated slot 42 of the handle assembly 24, a male seating member 64 supported by the ram 62 and positioned within the interior portion 44 of the support container 12, and a female seating member 66 disposed within and supported by the interior portion 44 of the support container 12 such that the female seating member 66 is alignable with the male seating member 64. Thus, upon slidable movement of the ram 62 through the elongated slot 42 of the handle assembly 24 in the direction of the arrow 68, the male seating member 64 engages the collapsible container 18 to seal or close the collapsible container 18 when the ram 62 is moved into the first position and the male seating member 64 is in a seating relationship with the female seating member 66.

Referring more specifically to FIGS. 1 and 4, the ram 62 is illustrated as an elongated member having a first end portion 70, a body portion 72 and an opposed second end portion 74. The body portion 72 of the ram 62 is slidably positioned within the elongated slot 42 formed in the upper segment 28 of the handle assembly 24 such that the first end portion 70 is disposed within the interior portion 44 of the support container 12 and the opposed second end portion 74 is disposed external the body portion 14 of the support container 12 and extends upwardly from the elongated slot 42 formed in the upper segment 28 of the handle assembly 24 substantially as shown in FIG. 2.

The male seating member 64 of the primary sealing assembly 20 is supported by and connected to the first end portion 70 of the ram 62. The male seating member 64 may be formed as an integral portion of the ram 62, or as a separate component. As more clearly illustrated in FIG. 4, the male seating member 64 of the primary sealing assembly 20 comprises an elongated extension member 76 having a first end 78 and an opposed second end 80. The opposed second end 80 is connected to and supported by the first end portion 70 of the ram 62 such that the elongated extension member 76 is substantially aligned with a centrally disposed elongated axis of the body portion 72 of the ram 62. A support member 82 is disposed between and connected to the first end 78 of the elongated extension member 76 and at least one male seating member 64. In many instances, a plurality of male seating members 64 will be employed, two of the male seating members 64 being illustrated in the embodiment shown in FIGS. 1, 2 and 4. When a plurality of male seating members 64 are employed in the construction of the primary sealing assembly 20, the end portions of the support member 82 is connected to a pair of secondary support members 84 and 86 which interconnect and support the male seating members 64 substantially as shown.

The body portion 72 of the ram 62 is further characterized as having a recessed portion 88 formed in a lower side 90 thereof, the recessed portion 88 extending from a medial portion 92 of the body portion 72 of the ram 62 to the second end portion 74 of the ram 62. The ram 62 is fabricated of a sufficient size to allow the ram 62 to slidably move through the elongated slot 42 formed in the upper segment 28 of the handle assembly 24. Thus, the portion of the second end portion 74 of the ram disposed between retaining lip members 57 and 59 of the upwardly extending side portions 53 and 55 of the handle assembly 24 and extending upwardly therefrom is provided with a cross section less than the cross section of the body portion 72 of the ram 62 substantially as shown in FIG. 4.

The ridge element 52 formed in the upper segment 28 of the handle assembly 24 serves as the supporting surface for the ram 62 as the ram is selectively moved between the first and the second position. In addition, the ridge element 52 of the upper segment 28 of the handle assembly 24 cooperates with the recessed portion 88 formed in the lower side 90 of the ram 62 to secure the ram 62, and thus the male seating member 64 in a seating relationship with the female seating member 66 when the ram is in the second position substantially as shown in FIG. 2.

To disengage the male seating member 64 from a seating relationship with the female seating member 66, one applies an upwardly directed force to the opposed second end portion 74 of the ram 62 so that the end 58 of the ridge element 52 of the upper segment 28 of the handle assembly 24 disengages the lip of the recessed portion 88 formed on the lower side 90 of the ram 62. After disengaging the lip of the recessed portion of the ram 62 from the end 58 of the ridge element 52 of the upper segment 28 of the handle assembly 24, the ram 62 can be slidably moved within the elongated slot 42 of the handle assembly 24 in a direction represented by the arrow 94 to the second position as shown in FIG. 1.

The male seating member 64 of the ram 62 can have any suitable configuration adapted to mate with the female seating member 66. For example, the male mating member 64 can be provided with an arcuate shaped configuration substantially as shown in FIG. 4. The female seating member 66 of the primary sealing assembly 20 is desirably formed as an integral part of the rigid support container 12 so that the female seating member 66 is disposed within the interior portion 44 of the support container 12. Further, the female seating member 66 is disposed substantially opposite the ram 62 so as to be substantially aligned with the male seating member 64 of the primary sealing assembly 20. The female seating member 66 is provided with at least one recessed portion 96 (two being illustrated in FIG. 5) adapted to receive the male seating member 64 when the ram 62 is in the second position so that a mating or seating relationship is established between the male seating member 64 and the female seating member 66. Thus, when the male seating members 64 are arcuate shaped members (as illustrated in FIG. 4), the recessed portions 96 formed in the female seating member 66 will be arcuate shaped recessed portions.

The ram 62 of the primary sealing assembly 20 is further provided with a leg member 100 secured to the first end portion 70 of the ram 62 so that the leg member 100 is substantially normally disposed to the elongated axis of the body portion 70 of the ram 62. The leg member 100 engages an interior surface of the support container 12 when the ram 62 is moved to the first position. Thus, the leg member 100 functions as a stop member for the ram 62 when same is in the first position.

As shown in FIG. 2, the pouring and receiving mouth 16 of the support container 12 is provided with threaded substantially cylindrically shaped portion 102 and a flared upper portion 104. The threaded substantially cylindrically shaped portion 102 of the pouring and receiving mouth 16 is adapted to threadably engage the secondary sealing assembly 26 when the secondary sealing assembly 26 is positioned within the pouring and receiving mouth 16 of the support container 12.

Referring now to FIG. 2, 6A and 6B, the secondary sealing assembly 26 employed for selectively opening and closing the pouring and receiving mouth 16 of the support container 12 comprises a first stopper member 110 having a substantially cylindrically threaded shaped body portion 112 and a flared upper portion 114. The threads formed on the cylindrically shaped body portion 112 of the first stopper member 110 are adapted to threadably engage the threads of the threaded cylindrically shaped portion 102 of the pouring and receiving mouth 16 of the support container 12 when the first stopper member 110 is positioned therein. The first stopper member 110 is further characterized as having a threaded bore 118 extending therethrough via an upper surface 120 of the flared upper portion 114 of the first stopper member 110. The threaded bore 118 is adapted to threadably receive a second stopper member 124 of the secondary sealing assembly 26 (when desired to seal off the threaded bore 118), or to receive the threaded portion of a container when it is desirable to introduce a fluid into the collapsible container 18 of the liquid storage and dispensing container 10 via the pouring and receiving mouth 16 of the support container 12.

To assist in the removal and insertion of the first stopper member 110 from and into the pouring and receiving mouth 16 of the support container 12, the first stopper member 110 further comprises a plurality of rib or extension members 126, 128 disposed on the upper surface 120 of the first stopper member 110. Thus, a person can grasp the rib members 126 and 128 to assist in the insertion and removal of the first stopper member 110 from the pouring and receiving mouth 16 of the support container 12.

The second stopper member 124 is provided with a threaded body portion 126 and an upper portion 128. The threaded body portion 126 of the second stopper member 124 is, as previously stated, positionable within the threaded bore 118 of the first stopper member 110 such that the upper portion 128 of the second stopper member 124 extends upwardly therefrom and can be grasped by a person's fingers for insertion and removal of the second stopper member 124 from the threaded bore 118 of the first stopper member 110.

The rigid support container 12, the primary sealing assembly 20 and the secondary sealing assembly 26 of the liquid storage and dispensing container 10 of the present invention can be fabricated of any suitable material, such as polyethylene, polypropylene, other polymeric materials and glass. The only requirement in the selection of materials to fabricate such components is that the material must have sufficient strength, rigidity and resilience to allow each of the components to carry out their intended functions. On the other hand, the collapsible container can be fabricated of any suitable material having sufficient strength to support the weight of the fluids contained therein, and yet which will render the collapsible container flexible and substantially impervious to fluids, such as liquids and gases. For example, a flexible polyethene material lined with a film of polyethylene terephthate can be employed in the fabrication of a collapsible container that possesses the desired strength and flexibility, and yet is substantially impervious to both liquids and gases.

It is clear that the present invention is well adapted to carry out the objects and to attain the ends and advantages mentioned as well as those inherent therein. While presently preferred embodiments of the invention have been described for purposes of this disclosure, numerous changes may be made which will readily suggest themselves to those skilled in the art and which are encompassed within the spirit of the invention disclosed and as defined in the appended claims.

What is claimed is:

1. A liquid storage and dispensing container comprising:

a substantially rigid support container having a pouring and receiving mouth and a pressure equalizing apperture for establishing fluid communication between an interior position of the support container and the ambient environment of the support container;

a substantially liquid and gas impervious collapsible container disposed within and supported by the support container, the collapsible container having an upper portion defining a opening therein, the upper portion of the collapsible container connected to the support container such that the opening in the collapsible container is in fluid communication with the pouring and receiving mouth of the support container;

primary sealing means supported by the support container and selectively movable between a first position and a second position, in the first position the primary sealing means disengaging the portion of the collapsible container so as to permit flow of liquids and gases into and from the collapsible container via the pouring and receiving mouth of the support container, in the second position the primary sealing means engaging a portion of the collapsible container a selected predetermined distance from the mouth of the support container and sealing the collapsible container so as to substantially prevent the escape and entry of liquids and gases from and into the collapsible container, said primary sealing means comprising:

a ram having a first end portion, a body portion and an opposed second end portion, the body portion slidably supported by the support container such that the first end portion of the ram is disposed within the interior portion of the body portion of the support container and the opposed second end is disposed external the body portion of the support container;

a male seating member supported by the first end portion of the ram; and a female seating member supported within the interior portion of the body portion of the support container and aligned with the male seating member such that upon moving the ram in the direction of the female seating member, the male seating member engages a portion of the collapsible liner disposed between the male seating member and the female seating member, and seals the collapsible container when the male seating member is in a seating relationship with the female seating member;

secondary sealing means for selectively opening and closing the pouring and receiving mouth of the support container, the secondary sealing means supported by a portion of the support container defining the pouring and receiving mouth thereof; and a handle assembly having an elongated upper segment supported by the support container, the elongated upper segment of the handle assembly being substantially normally disposed to a central elongated axis of the body portion of the support container, the upper segment of the handle assembly having an elongated slot formed therein, the elongated slot communicating with the interior portion of the body portion of the support container and adapted to slidably receive the body portion of the ram such that the opposed second end portion of the ram extends outwardly from the elongated slot.

2. The liquid storage and dispensing container of claim 1 wherein the handle assembly further comprises:

stop means supported within the elongated slot for selectively engaging and locking the body portion of the ram when the ram is moved to the second position for sealing the collapsible container via a seating engagement of the male seating member and the female seating member.

3. The liquid storage and dispensing container of claim 2 wherein the primary sealing means further comprises a leg member secured to the body portion of the ram so as to be disposed at the first end portion of the ram and to extend substantially normal to the elongated axis of the body portion of the ram, the leg member adapted to engage an interior portion of the support container when the ram is moved to the first position.

4. The liquid storage and dispensing container of claim 3 wherein the female seating member is provided with at least one arcuate shaped recessed portion formed therein, and wherein the male seating member comprises at least one arcuate shaped member positionable within the arcuate shaped recessed portion of the female seating member when same are in a mating relationship.

5. The liquid storage and dispensing container of claim 3 wherein the secondary sealing means comprises:

a first stopper member having a body portion positionable within the pouring and receiving mouth of the support container.

6. The liquid storage and dispensing container of claim 5 wherein the pouring and receiving mouth of the support container is a substantially cylindrically shaped opening having a flared upper portion, the body portion of the first stopper member is substantially cylindrically shaped member, and the first stopper member is further characterized as having a flared upper portion.

7. The liquid storage and dispensing container of claim 6 wherein the flared upper portion of the first stopper member is provided with an upper surface, and the secondary sealing means further comprises a plurality of projection members formed on the upper surface of the first stopper member such that a person can grasp the projection members when inserting and removing the first stopper member from the pouring and receiving mouth of the support container.

8. The liquid storage and dispensing container of claim 7 wherein the substantially cylindrically shaped opening of the pouring and receiving mouth and the body portion of the first stopper member are provided with mating threads for selectively securing the first stopper member to the body portion of the support container and selective closing the pouring and receiving mouth thereof.

9. The liquid storage and dispensing container of claim 8 wherein the first stopper member is provided with a bore extending thereto via the upper surface, and wherein the secondary sealing means further comprises a second stopper member positionable with the bore in the first stopper member for closing the bore, the second stopper member being removable from the bore of the first stopper member so that fluids can be admitted into and withdrawn from the collapsible container via the bore in the first stopper member.

10. The liquid storage and dispensing container of claim 9 wherein the second stopper member is provided with a body portion and an upper portion, the body portion positionable with the bore of the first stopper member such that the upper portion of the second stopper member extends therefrom and is adapted to be grasped for insertion and removal of the second stopper member from the bore of the first stopper member.

11. The liquid storage and dispensing container of claim 10 wherein the body portion of the second stopper member and the bore of the first stopper member are provided with mating threads.

12. The liquid storage and dispensing container of claim 2 wherein the handle assembly further comprises a medial segment and a lower segment, the lower segment connected to and supported by the body portion of the support container in a spatial relationship with the elongated upper segment of the handle assembly, the medial segment disposed between and connected to the elongated upper segment and the spatially disposed lower segment such that an opening is formed therebetween to allow grasping of the handle assembly.

13. An improved liquid container comprising:

a substantially rigid support container having a body portion defining a pouring and receiving mouth;

a collapsible, fluid impermeable container disposed within and supported by the support container, the collapsible container openly communicating with the mouth of the support container;

a handle assembly supported by the support container, the handle assembly having an elongated upper segment substantially normally disposed to a central elongated axis of the support container, the handle assembly further characterized as having an elongated slot formed in the elongated upper segment such that the elongated slot openly communicates with an interior portion of the support container; and primary sealing means supported by the handle assembly and movable between a first position for sealing the collapsible container and a second position wherein the collapsible container openly communicates with the pouring and receiving mouth of the support container, the primary sealing means comprising:

a ram having a first end portion, a body portion and an opposed second end portion, the body portion of the ram slidably positioned within the elongated slot formed in the upper segment of the handle assembly such that the first end portion of the ram is disposed within the interior portion of the support container and the opposed second end portion of the ram extends outwardly from the elongated slot;

a male seating member connected to the first end portion of the ram; and a female seating member supported within the interior portion of the support container and aligned with the male seating member such that upon moving the ram in the direction of the female seating member, the male seating member engages a portion of the collapsible container disposed between the male seating member and the female seating member and seals the collapsible container when the male seating member is in a seating relationship with the female seating member.

14. The improved liquid container of claim 13 wherein the handle assembly further comprises:

stop means supported within the elongated slot for selectively engaging and locking the ram in the second position when the ram is slidably moved to the second position to seal the collapsible container.

15. The improved liquid container of claim 13 wherein the elongated upper portion of the handle assembly is provided with a ridge member extending upwardly into the elongated slot, the ridge member extending from a medial portion of the upper segment to an outwardly extending distal end portion of the upper segment of the handle assembly, the body portion of the ram is provided with a recessed portion extending from a medial portion of the body portion of the ram in the direction of the first end portion of the ram, the ridge member of the handle assembly cooperating with the recessed portion of the ram such that upon movement of the ram through the elongated slot of the handle assembly to the second position the ridge element of the ram engages the recessed portion of the handle assembly, and upon application of an upwardly directed force on the opposed second end of the ram the ridge element of the ram disengages the recessed portion in the ram so that the ram is slidably movable within the elongated slot of the handle assembly to the first position.

16. The improved liquid container of claim 15 wherein the primary sealing means further comprises:

a leg member secured to the first end portion of the ram, the leg member extending from the body portion of the ram so as to be disposed substantially normal to the elongated axis of the body portion of the ram, the leg member adapted to engage an interior portion of the support container when the ram is in the first position.

17. The improved liquid container of claim 16 wherein the female seating member is provided with at least one arcuate shaped recessed portion formed therein, and wherein the male seating member comprises at least one arcuate shaped member secured to the first end portion of the ram, the arcuate shaped member of the male seating member positionable within the arcuate shaped recessed portion of the female seating member when the ram is in the second position.

18. The improved liquid container of claim 14 wherein the body portion of the support container is provided with a pressure equalizing aperture for establishing fluid communication between an interior portion of the body portion of the support container and the ambient environment of the support container.

19. The improved liquid container of claim 18 further comprising:

secondary sealing means for selectively opening and closing the pouring and receiving mouth of the support container, the secondary sealing means supported by the body portion of the support container defining the pouring and receiving mouth thereof.

20. The improved liquid container of claim 19 wherein the secondary sealing means comprises:

a first stopper member having a body portion positionable within the pouring and receiving mouth of the support container.

21. The improved liquid container of claim 20 wherein the pouring and receiving mouth of the support container is a substantially cylindrically shaped opening having a flared upper portion, the body portion of the first stopper member is substantially cylindrically shaped member, and the first stopper member is further characterized as having a flared upper portion.

22. The improved liquid container of claim 21 wherein the flared upper portion of the first stopper member is provided with an upper surface, and the secondary sealing means further comprises a plurality of rib members formed on the upper surface of the first stopper member such that a person can grasp the rib members when inserting and removing the first stopper member from the pouring and receiving mouth of the support container.

23. The improved liquid container of claim 22 wherein the substantially cylindrically shaped opening of the pouring and receiving mouth and the body portion of the first stopper member are provided with mating threads for selectively securing the first stopper member to the body portion of the support container and selective closing off the pouring and receiving mouth thereof.

24. The improved liquid container of claim 23 wherein the first stopper member is provided with a bore extending thereto via the upper surface, and wherein the secondary sealing means further comprises a second stopper member positionable with the bore in the first stopper member for closing off the bore, the second stopper member being removable from the bore of the first stopper member so that fluids can be disposed into and from the collapsible container via the bore in the first stopper member.

25. The improved liquid container of claim 24 wherein the second stopper member is provided with a body portion and an upper portion, the body portion positionable with the bore of the first stopper member such that the upper portion of the second stopper member extends therefrom and is adapted to be grasped for insertion and removal of the second stopper member from the bore of the first stopper member.

26. The improved liquid container of claim 25 wherein the body portion of the second stopper member and the bore of the first stopper member are provided with mating threads.

27. The improved liquid container of claim 13 wherein the handle assembly further comprises a medial segment and a lower segment, the lower segment connected to and supported by the body portion of the support container in a spatial relationship with the elongated upper segment of the handle assembly, the medial segment disposed between and connected to the elongated upper segment and the spatially disposed lower segment such that an opening is formed therebetween to allow grasping of the handle assembly.

* * * * *